United States Patent [19]

Piccino et al.

[11] 3,955,380

[45] May 11, 1976

[54] KNITTING MACHINE PATTERNING DEVICE

[75] Inventors: Pierre-Michel Piccino, Geneva, Switzerland; Juan-Ramon Moreu Orobitg, Premia de Mar, Spain

[73] Assignee: Jumberca, S.A., Badalona, Spain

[22] Filed: Feb. 22, 1974

[21] Appl. No.: 444,899

[30] Foreign Application Priority Data

Feb. 28, 1973 Switzerland ..... 2893/73

[52] U.S. Cl. ..... 66/50 R; 66/50 B

[51] Int. Cl.[2] ..... D04B 15/76

[58] Field of Search ..... 66/50 B, 50 R, 25

[56] References Cited

UNITED STATES PATENTS

| | | | |
|---|---|---|---|
| 1,927,016 | 9/1933 | Adler et al. | 66/50 R X |
| 3,423,960 | 1/1969 | Wiesinger et al. | 66/25 |
| 3,724,240 | 4/1973 | Flad | 66/50 R |
| 3,771,328 | 11/1973 | Schindele et al. | 66/50 R |
| 3,811,297 | 5/1974 | Hamma | 66/50 R |
| 3,815,383 | 6/1974 | Hamma | 66/50 R |
| 3,818,728 | 6/1974 | Erb | 66/50 R X |
| 3,823,579 | 7/1974 | Schindele et al. | 66/50 R |
| 3,864,942 | 2/1975 | Savage et al. | 66/50 R |

FOREIGN PATENTS OR APPLICATIONS

| | | | |
|---|---|---|---|
| 1,522,413 | 4/1967 | France | 66/50 R |
| 2,012,445 | 3/1970 | France | 66/50 B |
| 1,182,796 | 3/1970 | United Kingdom | 66/50 R |

*Primary Examiner*—Louis K. Rimrodt
*Assistant Examiner*—A. Falik
*Attorney, Agent, or Firm*—H. J. Staas; James D. Halsey, Jr.

[57] ABSTRACT

A knitting machine in which the needle selection is performed electromagnetically from a programmed control. Selectors having spring return means are adapted to occupy an operative position in which they engage means for moving the needles to their working position. The selectors are attached to the knitting machine frame and are moved against said spring means by cocking members mechanically connected to the knitting machine needle bed drive means. An electromagnetic holding means attached to the machine frame and associated with the cocking members is arranged selectively to hold the selectors in the cocked position when driven by a programmed control synchronised with the needle bed movement and with the selection device.

3 Claims, 6 Drawing Figures

KNITTING MACHINE PATTERNING DEVICE

BACKGROUND OF THE INVENTION

The present invention relates to knitting machines and more particularly to knitting machines where the needle selection is performed electromechanically with the aid of data supplied by a numerical programme, for example, or by a magnetic tape or even by a punched tape.

In these knitting machines, each needle is generally controlled by a jack for selectively moving the needle to the working position. The selection mechanisms controlled by an electromagnet have the task of placing the jack as required in the active position, from which position a cam moves the jack in the needle direction to place the needle directly or indirectly into its operative position. Indeed, in several known mechanisms, the jack moves the needle until a needle butt engages a cam which then carries it to the operative position.

Some of the known devices subject the selector member to a recovery spring which constantly tends to bias this member to the rest position. This arrangement requires an electromagnet sufficiently strong to overcome the bias of the recovery spring.

Other devices do not use a recovery spring to return the selector member to the rest position but two electromagnets and a permanent magnet attached to the selector member. Thanks to this arrangement, the selector member moves from one electromagnet to the other when their polarity is inverted. Here the use of a spring is avoided by adding a second electromagnet.

A further known device uses two counteracting springs associated with each needle. One of these springs tends to hold the jack constantly in the selection position. At each feed, the second of said springs engages a fixed cam which cocks it with centrifugal movement to move it to the proximity of a fixed selection electromagnet. If the needle should not be selected, this electromagnet repels said second spring which then engages a ramp of a second cam which moves it in a centripetal direction. During this movement, this spring presses the jack against the action of said first spring and thus separates it from the upthrow cam. Otherwise, the electromagnet holds this second spring until it engages with a separation ramp of the second cam, thereby preventing it from operating against the first spring, so that the jack is raised by the upthrow cam.

With this device, the electromagnet works only on contact with the spring, which is an advantage with respect to the devices where the electromagnet must attract the spring itself.

However, this construction has many other disadvantages. In the first place, it only allows for selection at a single level per feed. Each needle has to be provided with two counteracting springs. Consequently, the number of springs is equal to twice the number of needles. The cocking spring works under disadvantageous conditions, since it has to overcome the bias of the levelling spring.

It is shown that in this construction, the means allowing a reduction of the power of the electromagnet afford disadvantages which are substantially as troublesome as those they allow to be overcome, so that the solution proposed does not provide real technical progress.

Also, certain knitting machines use selection at several levels by disposing several stacked selectors per feed, in order to increase the time available for performing selection, giving the possibility of accelerating the speed of relative movement of the selectors and of the knitting head carrying the needles and, consequently, of increasing production. Therefore, it is important that the selection devices used should be neither too large nor too expensive, whilst still providing complete operational reliability. The space occupied and the price of the electromagnets is not negligible if one considers that a machine may have, for example, 48 feeds of 10 selectors each, making a total of 480 selectors. If each selector uses two electromagnets as in one of the aforementioned solutions, 960 would be needed.

SUMMARY OF THE INVENTION

The object of the present invention is to remedy, at least partially, the disadvantages of the above-mentioned solutions, whilst increasing the operational reliability of the knitting machine.

To this end, the object of the present invention is a knitting machine having a frame, a needle bed movable with respect to the frame, a plurality of needles mounted in said needle bed and capable of occupying at least two positions, a working position and a rest position, drive means for said needle bed, means for moving said needles from one to the other of said positions and vice versa and a selector device for the position of said needles, comprising at least one selector member capable of occupying two positions, an operative one in which it engages said means and an inoperative one in which it is disassociated from said means, resilient return means tending constantly to bias this member to one of said positions, means for moving said member to the other of said positions against said resilient return means. This knitting machine is characterised by the fact that said selection member is attached to said frame and that said means for moving said selection member to the other of said positions is constituted by a cocking member mechanically coupled to the driving device and in that said selection member, in its position defined by said return means, occupies a position lying in the path of said cocking member and is associated with an electromagnetic holding device attached to the frame and arranged to retain selectively said selection member in its position defined by said cocking member, said holding device being driven by a programmed control synchronised with the movement of said needle bed and said selection device.

The mechanical link between the knitting machine drive device and the cocking member may take on several forms which, advantageously may consist of using a kinematic link mechanism or using transmission jacks housed in the vertical tricks of the needle bed as members forming part of the cocking member.

The kinematic link mechanism between the drive device and the cocking member to move the selector member from the position defined by the resilient means allows the force of the knitting machine drive device to be used at the same time as it allows strict synchronisation of the functions. The same happens with the use of transmission jacks housed in the vertical tricks of the needle bed.

Also, the fact that the cocking member is associated with the driving device of the knitting machine allows the resilient returns means to be associated with the selector member and not with the needles, which is a great advantage. The number of springs will, indeed, be equal to the number of selectors and no longer to twice the number of needles, as in one of the abovementioned solutions. Also, the transfer of the springs from the needles to the selectors allows several selectors to be arranged per feed. Finally, the selector is subject to the action of only one return spring.

BRIEF DESCRIPTION OF THE DRAWINGS

The attached drawings show only as an example three embodiments of the knitting machine of the present invention.

DESCRIPTION OF THE PREFERRED EMBODIMENTS

Figure 1:
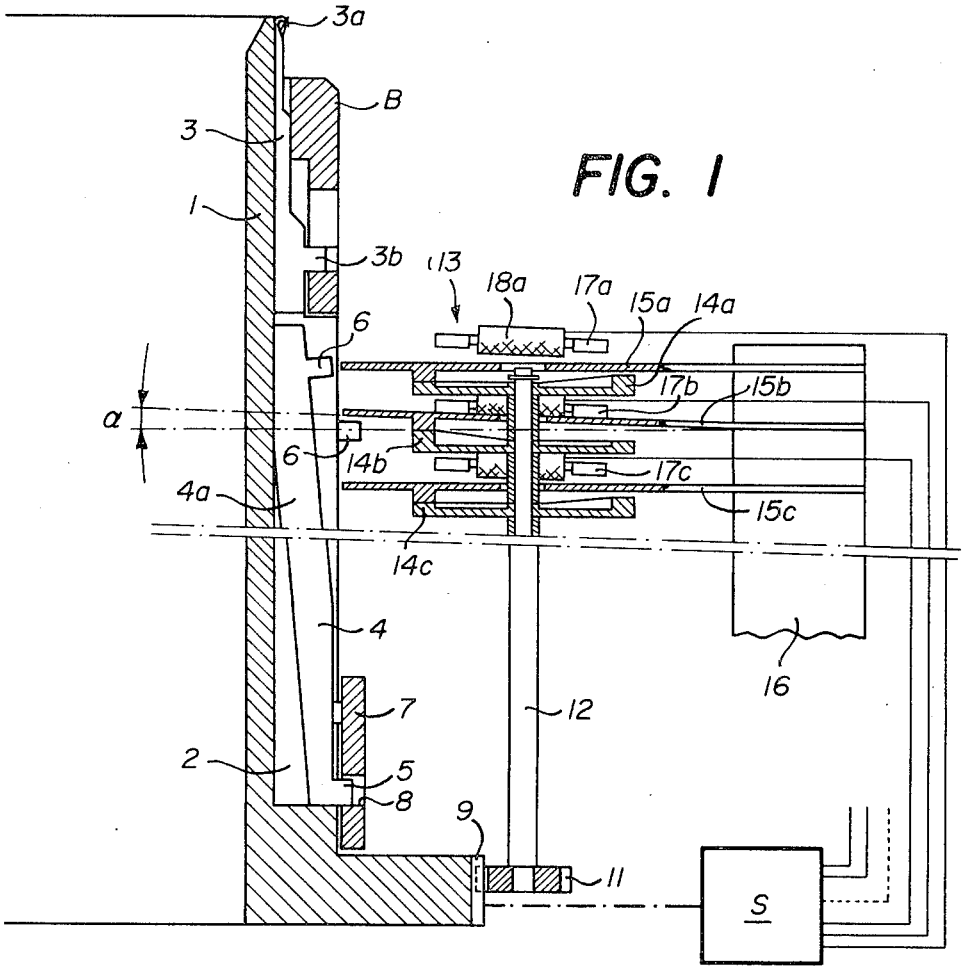
FIG. 1 is a partial diametrical cross section view along the line I—I of FIG. 1A, corresponding to a first embodiment of the knitting machine.

The knitting machine shown as in example in the drawings is a circular Jacquard type machine. Nevertheless, it is obvious that the principles of the selection mechanism more particularly described and shown are applicable to the selection of the needles of flat knitting machines.

Figure 2:
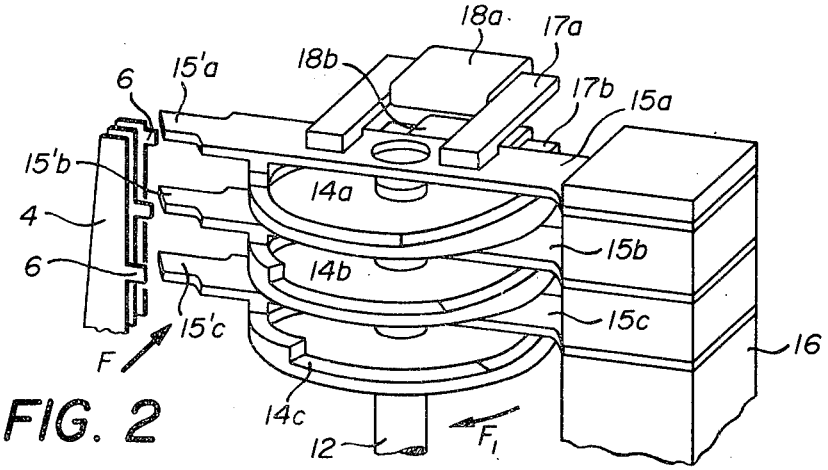
FIG. 2 is a partial view of FIG. 1 in perspective.
Figure 1A:
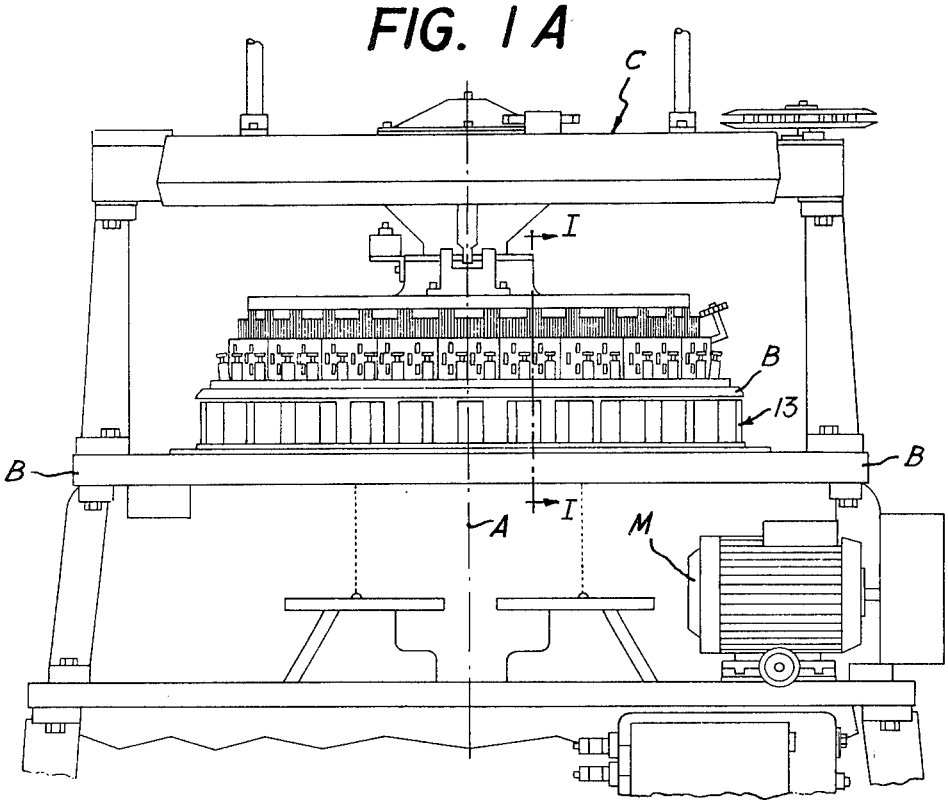
FIG. 1A is an elevation view, partially in section, of a Jacquard type circular knitting machine from which several peripheral members attached to the machine frame, such as legs, feed creel, take-up beam, etc. have been removed.

In FIG. 1A, in particular, there is to be seen a circular knitting machine C, the needle bed of which (not shown) is mounted rotatably in a frame B around a axis A and caused to rotate by a motor M in the direction of the arrow F (FIG. 2).

A plurality of radial slots or tricks 2, one of which is to be seen in FIG. 1, are arranged in the outer surface of the needle bed 1. Each trick houses a needle 3, the upper end of which ends in a latch 3*a*, and a jack 4. Said needle 3 and said jack 4 are both a friction fit in the trick 2 so as to be able to slide therein. Also, the edge of the jack facing the bottom of the trick has an elbow 4*a* enabling said jack to rock around an imaginary axis corresponding to the centre of curvature of the elbow 4*a*. Each jack 4 has a butt 5 at its lower end and a finger 6 in the vicinity of its upper end. As may be seen particularly in FIG. 2, fingers 6 of successive jacks 4 are at different levels for a purpose to be explained hereinafter. It is also to be seen in FIG. 1 that a levelling cam 7, movable with respect to the needle bed, is situated at the level of the butts 5. The purpose of this cam is to situate all the jacks in the same position in advance of each feed by pushing their butts 5 towards the bottom of the trick 2. A second cam 8 is constituted by a window through the levelling cam 7 at the level of the circular path described by the butts 5 of the jacks. The purpose of this cam is to control the uplift of the jacks when their butts 5 extend radially outward from the radial tricks 2.

A crown wheel 9 coaxial with the axis of the needle bed 1, surrounds the base of the latter. This crown wheel meshes with a pinion 11 attached to the end of a shaft 12 for driving the selection mechanism 13.

Ten cams constituting the cocking members, of which only three are shown in the drawings, 14*a*, 14*b*, 14*c* are keyed on the shaft 12 in certain angular positions which are different for each cam (FIG. 2). Ten selector members, of which only three are visible in the drawing, 15*a*, 15*b*, 15*c* are associated with the cams 14*a*, 14*b*, 14*c*, respectively. These selector members are constituted by resilient metal strips anchored at one of their respective ends to a support 16 attached to the knitting machine frame and having at their respective opposite ends three leading edges 15'*a*, 15'*b* and 15'*c* (FIG. 2). The purpose of these leading edges is to select the jacks 4 by acting on their fingers 6 situated at the respective levels of these leading edges.

In their free state, the resilient strips of these selectors form an angle of 90° with the anchorage support. Their leading edges 15'*a*, 15'*b* and 15'*c* are then situated at the above mentioned respective levels, that is, in the path of the respective fingers 6.

The armatures 17*a*, 17*b*, 17*c* of three electromagnets 18*a*, 18*b* and 18*c* extend over the resilient strips of the selector members 15*a*, 15*b*, 15*c* and are arranged in such a way that their pale faces make contact with the upper surface of these selectors when the resilient strips are raised in an angle $\alpha$ with respect to their rest position. These electromagnets are connected selectively to a control unit S programmed for the pattern to be knitted. Also, a kinematic link shown by the dot-dash line connects the control unit to the knitting machine driving mechanism. This control unit S is based on a system of binary information synchronised with the angular movement of the needle bed 1, in order to send pulses as required to the respective electromagnets at the time of selecting the respective needles, as will be explained in greater detail in the description of the operation of the knitting machine to be given below.

As previously mentioned, the motor drives the needle bed 1 in the direction of the arrow F. Since the pinion 11 meshes with the crown wheel 9, the shaft 12 and the cams 14*a*, 14*b*, 14*c* of the selector mechanism secured to this shaft turn in the direction of the arrow $F_1$ (FIG. 2). The purpose of these cams is to raise in turn the selectors 15*a*, 15*b*, 15*c* just before the respective fingers 6 of the jacks 4 reach the respective angular positions corresponding to the cams 15'*a*, 15'*b*, 15'*c* of the respective selectors. The selectors are therefore brought into contact with the respective armatures 17*a*, 17*b*, 17*c* of the electromagnets 18*a*, 18*b*, 18*c*. In this position the cams 15'*a*, 15'*b* and 15'*c* are at a higher level than the fingers 6 of the respective jacks. Also, as seen particularly in FIG. 2, the cams 14*a*, 14*b*, 14*c* are angularly staggered. This staggering is equal to the angular displacement of two successive fingers 6 multiplied by the ratio between the crown wheel 9 and pinion 10.

When the selector member 15*a*, for example, is brought into contact with the armature 17*a* by the cam 14*a*, as shown in FIG. 2, the control unit S is synchronised in such a way that it sends a pulse to the electromagnet 18*a* if the corresponding needle 3 is not to be selected. Otherwise, the armature 17*a* releases the selector member 15*a* once the ramp of the leading edges 14*a* has left the selector member 15*a*, the leading edges 15'*a* of which drops to the level of finger 6 of its respective jack 4. This finger 6 now engages the leading edge 15'*a* which causes the jack 4 to rock around its elbow 4*a* and the upper end of the jack to return to its radial trick 2. This rocking movement causes the butt 5 to project from the trick and this butt now penetrates in the window forming the cam 8, the purpose of which is to raise the jack 4 towards the needle 3 and immediately return it to its initial position. The needle 3 also has a butt 3*b* for engaging with a cam (not shown) similar to cam 8 arranged in the frame B. The purpose of the jack 4, therefore, is to carry the butt 3*b* of needle 3 to the level of the start of this cam.

When the jack 4 shown in FIG. 1 reaches the following feed, its position is the same as the one selected by the selector member 15*a*, that is, with its butt 5 projecting from the trick 2, whilst its finger 6 is hidden within the trick. The purpose of the levelling cam 7, disposed in front of the selection mechanism 13 of the following feed, is precisely to reinsert in their respective tricks all the projecting butts. This levelling operation performed by the cam 7 causes the jacks 4 to rock about their elbow 4*a* and thus all the fingers 6 project from the tricks 2 before passing by their respective selector member.

Let us suppose now that the selector member 15*a* should not select a needle. As before, the cam 14*a* lifts the selector member 15*a* before the passing of finger 6 before the leading edge 15'*a*. When the selector member 15*a* touches the armature 17*a*, the electromagnet 18*a* is energised and, when the cam releases the selector 15*a*, since this is held by the attraction of the electromagnet, the resilient strip forming the selector member 15*a* remains bent slightly upwards. Leading edge 15'*a* is then at a higher level than the finger 6 so that the latter passes under this leading edge 15'*a* and remains projecting from its trick 2. Since the butt 5 does not project outwardly, it does not engage with the cam 8, so that the needle 3 remains in its lower position in which it cannot knit.

Certain advantages of the knitting machine selector mechanism just described have already been listed. This mechanism also provides several constructional advantages which are to be deduced from the preceding description. Among them, it may be mentioned that the springs are replaced by selector member constituted by resilient strips which are extremely pliant in one direction whilst they are rigid in a direction perpendicular to said one direction. This perculiarity is interesting because the reaction of the fingers 6 of the jacks 4 against the leading edges 15'*a*, 15'*b*, 15'*c* of the selector member is produced precisely in the direction of the greatest degree of rigidity of the selector member. On the other hand, the armatures of the electromagnet work in the direction of greatest pliancy of the selector member, so that the reaction of the fingers of the jacks against the selector member does not tend to separate the selector member from the armatures of the respective electromagnets.

Figure 3:
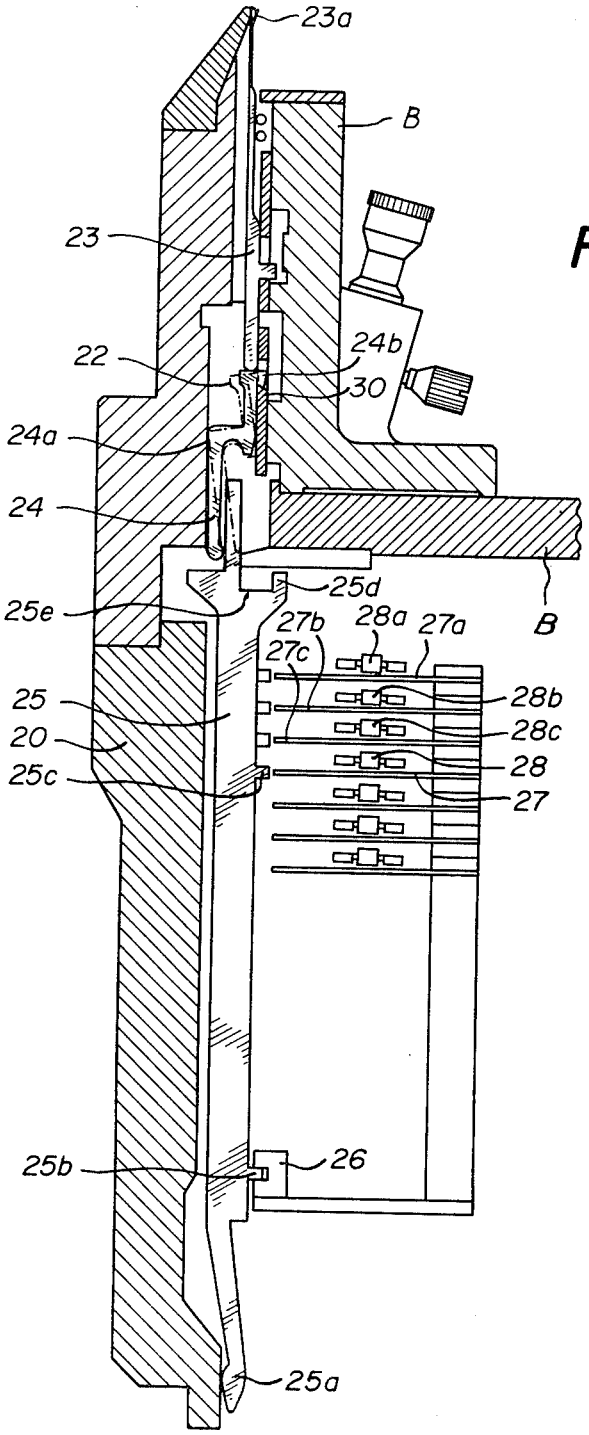
FIG. 3 is a partial diametrical cross section view similar to FIG. 1 but corresponding to a second embodiment.
Figure 4:
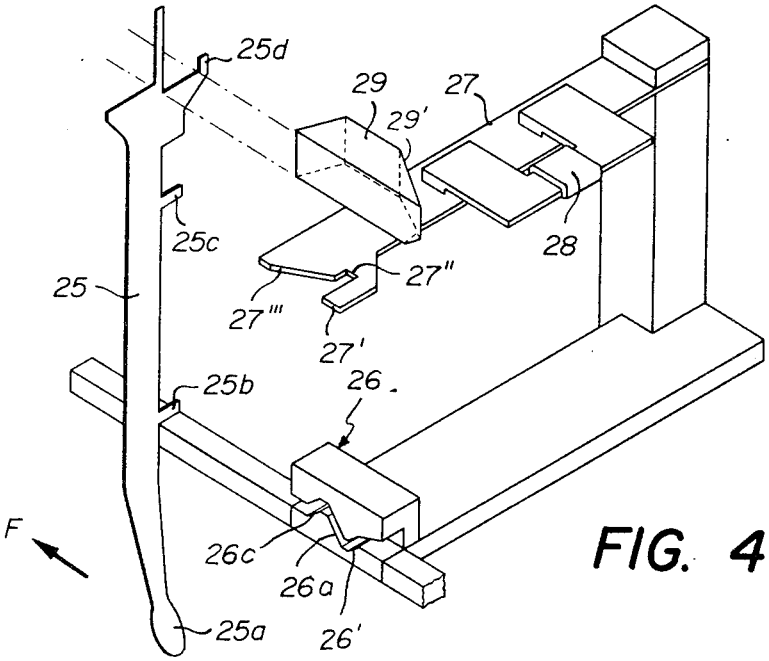
FIG. 4 is a perspective view of the diverse functional elements of the second embodiment of the selection device.

FIGS. 3 and 4 show a second embodiment of the knitting machine of the present invention.

This second embodiment differs from the first, in essence, in that the cocking member is no longer constituted by the rotary cams 14 but by a vertically operative cocking cam which is fixed with respect to the machine frame and by a transmission jack slidingly housed in a vertical trick of the needle bed. This transmission jack is located between the cocking cam and the corresponding selector and has a first butt for engaging the cocking cam and a second butt for carrying the selector into contact with the pole face of the electromagnet.

Let us now see in detail the structure of the arrangement shown in FIGS. 3 and 4. The needle of cylinder 20 of this circular knitting machine is mounted rotatably in a frame (not shown) around a vertical axis and caused to rotate by a motor (not shown) in the direction of the arrow F (FIG. 4).

A plurality of radial tricks 22, one of which is visible in FIG. 3, are arranged on the outer surface of the needle bed 20. Each trick 22 houses a needle 23, the upper end of which terminates in a latch 23*a*, and a jack 24. Said jack 24 is mounted slidingly and rockingly in the trick 22. Rocking takes place around its elbow 24*a* and is controlled by a selection transmission jack 25 which rocks around a rounded surface 25*a* arranged at its lower end and which bears against the needle bed 20. Said jack 25 has two butts 25*b* and 25*c*. Butt 25*b* situated towards the lower end of the jack 25 is arranged to engage periodically a fixed cam 26, the purpose of which will be explained hereinafter; this fixed cam 26 has a preparation ramp 26', a cocking ramp 26*a* and an uncocking ramp 26*c*. The upper butt 25*c* cooperates with the selector 27 constituted by a resilient strip normally held a certain distance below the armatures of an electromagnet 28 identical to the electromagnets 18 of the first embodiment.

Although only one selector 27 has been shown in FIG. 4, in reality each feed will comprise several stacked selectors 27*a*, 27*b*, 27*c* . . . as shown in FIG. 3, each selector being associated with a respective electromagnet 28*a*, 28*b*, 28*c* . . . Consequently, the upper butts 25*c* of the different selection jacks 25 will be situated at respective levels corresponding to the levels of the selectors with which they are associated.

The selection transmission jack 25 also has a laterally extending bent arm 25*d* which, when the jack is caused to rotate by the needle bed 20, describes a path along which there is a fixed levelling cam 29 for causing the selection transmission jack 25 to rock towards the right with respect to the position shown in FIG. 3.

As will be seen in FIG. 4, the leading end of the selector 27 has three portions 27', 27'' and 27'''.

Portion 27' constitutes the cocking zone, portion 27'' is an interval between the cocking zone 27' and portion 27''' which constitutes the selector cam proper.

The above described selection mechanism works as follows:

The selection transmission jack 25 is moved in the direction of the arrow F. The lower butt 25*b* engages first of all in the slot of the fixed cam 26 and, simultaneously, the start of the levelling cam 29 engages behind the bent arm 25*e* of the selection jack. The sloping portion 29' of this cam causes the jack 25 to rock outwardly. When this rocking movement is finished, the preparation ramp 26' of the fixed cam 26 causes jack 25 to descend slightly so as to carry its upper butt 25*c* to a level lower than that of the selector 27. Butt 25*c* engages then under portion 27' of the selector and, simultaneously, jack 25 is lifted by the cocking ramp 26*a* of cam 26. This movement of the jack 25 cocks the selector 27 by raising it upwards and bringing it into contact with the armature of the electromagnet 28. At thata time, the programmed control device sends a pulse or refrains from sending a pulse according to whether the needle 23 should knit or not knit.

Let us suppose that the electromagnet receives a pulse. The selector remains attracted to the armature of the electromagent. Once the butt 25*c* has left portion 27′ of the selector, the uncocking ramp 26*c* of cam 26 lowers jack 25 slightly whilst butt 25*c* is in portion 27″ of the selector, preceding cam portion 27‴. Since the selector 27 is still attracted to the armature of electromagnet 28, butt 25*c* passes under cam 27‴ so that the selection jack remains in the position set by the levelling cam 29. Jack 24 remains in the position shown by the dotted line in FIG. 3 so that the head 24*b* of the jack is out of reach of the upthrow cam 30.

If, on the contrary, the electromagnet receives no pulse, the selector returns to its initial position at the time when the butt 25*c* leaves portion 27′ of the selector, that is, the selector drops to return to its position spaced from the electromagnet thanks to its resilience. After the selection jack 25 has returned to its initial level, butt 25*c* strikes cam 27‴ of the selector. This cam pushes the jack 25 inwardly. On rocking, jack 25 carries with it jack 24 which, in turn, then rocks around its elbow 24*a*, carrying the head 24*b* into the path of the upthrow cam 30 which carries the jack 24 and needle 23 to the high position, that is, to the knitting position.

The operation described here for one needle is identical for the other needles, simply the level of the butt 24*c* varies from one jack 25 to another to adapt each jack 25 to the level of the selector with which it has to work in each feed.

Figure 5:
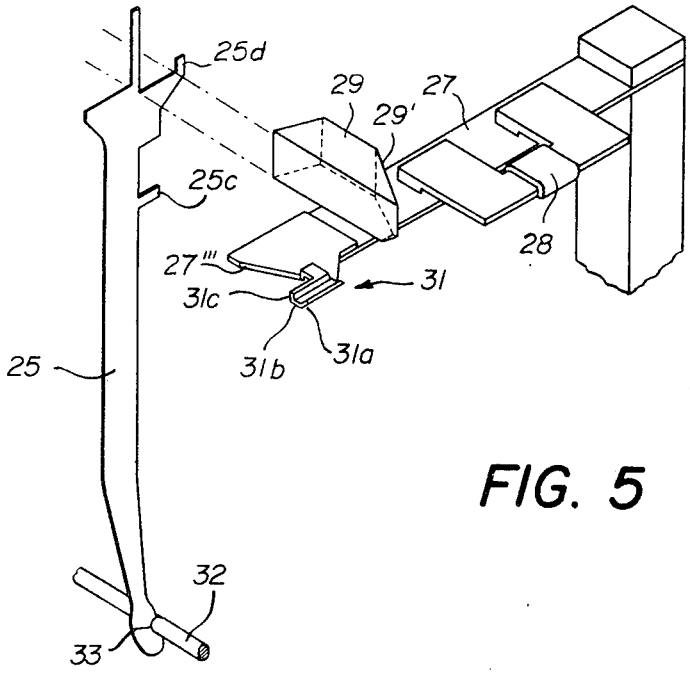
FIG. 5 is a perspective view of the diverse functional elements of a third embodiment of the selection device.

The embodiment of FIG. 5 represents a remarkable simplification with respect to the embodiment of FIGS. 3 and 4 and contains several common elements with that embodiment, so that like reference characters are used to designate like parts.

In this embodiment butt 25*b* and the fixed cam 26 are removed. Fixed cam 26 is replaced by a cam 31 arranged in the portion corresponding to portion 27′ of the selector 27 of FIG. 4. This cam comprises a cocking ramp 31*a*, a flat portion 31*b* and an uncocking area 31*c*. The rest of the selector, that is, the selection cam 27‴ is identical to the selector of FIGS. 3 and 4. In this embodiment, butt 25*c* serves, therefore, at the same time for cocking the selector when it strikes the cocking ramp 31*a* and for causing the selection jack to rock when it strikes the selection cam 27‴.

The operation is, therefore, identical to that described for FIGS. 3 and 4, except for the role of cam 26 and butt 24*b*, replaced here by the cam 31 and butt 24*c*.

Of course, in this embodiment, since the selection transmission jack 25 must raise the selector 27 without the aid of a cam 26, it is necessary for this jack to be held about the fixed rocking point. For this purpose, the jacks 25 may be retained around the needle bed by a cable or piano wire 32 housed in a recess 33 arranged in the base of the jack 25.

In the embodiment shown in FIG. 5, the great simplicity of selection and also reliability, notably in the synchronisation, is to be observed. All the advantages listed for the first embodiment are found in the second and third embodiments just described above.

What we claim is:

1. A knitting machine, comprising:

a frame;

a needle bed mounted for rotation with respect to said frame;

a plurality of needles mounted within said needle bed and capable of occupying an operative position and a rest position;

a driving device for said needle bed;

means for moving said needles from said operative position to said rest position and visa versa;

a selector device for positioning said means for moving said needles, comprising:

one selector member fixed to said frame and capable of occupying an operative position wherein said selector member engages said means for moving said needles and an inoperative position wherein said selector member is disengaged from said means for moving said needles, said selector member being provided with resilient return means biasing said selector member towards one of said positions when it is in the other of said positions; and cocking members provided with at least one circular cam mechanically coupled to said driving device and adapted to move said selector member through said circular cam applied directly thereagainst when said selector member is in said one of said positions to said other position against the force of said resilient return means; and electromagnetic means for selectively retaining said selector member when it is moved to said other position by said cocking member and being actuated by a programmed control synchronised with the rotation of said needle bed and said selector device.

2. A knitting machine as in claim 1, wherein said cocking members include a disc, said circular cam extending laterially outwardly from the surface of said disc, and wherein said selector member comprises a resilient strip attached at a rear end thereof to said frame of the knitting machine and extending in a plane substantially perpendicuar to the axis of said disc and within reach of said cam, said selector member having a leading edge in the immediate proximity of said needle bed, fingers projecting radially outwardly from said needle bed and fixed to said means for moving said needles, said leading edge of said selector member being adapted to radially move said fingers when said selector member is in said operative position and being separated from the path of said fingers when said selector member is in said inoperative position.

3. A knitting machine as in claim 2, wherein said electromagnetic means is provided with an armature having a pole face extending in front of said selector member in a plane corresponding to that of the surface of said selector member when said selector member is in said other of said positions.

* * * * *